US007964831B2

(12) United States Patent
Hurty

(10) Patent No.: US 7,964,831 B2
(45) Date of Patent: Jun. 21, 2011

(54) REMOTE CONTROL DEVICE FOR A TARGET DESIGNATOR FROM AN ATTACK MODULE, ATTACK MODULE AND DESIGNATOR IMPLEMENTING SUCH DEVICE

(75) Inventor: Michel Jean Hurty, Plaimpied (FR)

(73) Assignee: Nexter Munitions, Versailles (FR)

( * ) Notice: Subject to any disclaimer, the term of this patent is extended or adjusted under 35 U.S.C. 154(b) by 117 days.

(21) Appl. No.: 12/285,096

(22) Filed: Sep. 29, 2008

(65) Prior Publication Data

US 2009/0114762 A1 May 7, 2009

(30) Foreign Application Priority Data

Oct. 3, 2007 (FR) ..... 07 06919

(51) Int. Cl.

| | |
|---|---|
| ***F41G 7/30*** | (2006.01) |
| ***F42B 15/01*** | (2006.01) |
| *F41G 7/00* | (2006.01) |
| *F42B 15/00* | (2006.01) |

(52) U.S. Cl. ..... 244/3.11; 244/3.1; 244/3.15; 244/3.16; 89/1.11; 356/138; 356/152.1

(58) Field of Classification Search ..... 244/3.1–3.3; 89/1.11, 1.1; 342/61–68; 356/138, 139.04, 356/139.07, 139.08, 140, 141.2, 141.4, 141.5, 356/152.1–152.3; 372/109

See application file for complete search history.

(56) References Cited

U.S. PATENT DOCUMENTS

| | | | | |
|---|---|---|---|---|
| 3,711,046 | A * | 1/1973 | Barhydt et al. | 244/3.12 |
| 3,799,676 | A * | 3/1974 | Chatterton | 356/139.08 |
| 4,100,545 | A * | 7/1978 | Tabourier | 342/62 |
| 4,143,835 | A * | 3/1979 | Jennings et al. | 244/3.11 |
| 4,259,009 | A * | 3/1981 | Jernigan | 244/3.16 |
| 4,349,838 | A * | 9/1982 | Daniel | 244/3.16 |
| 4,354,419 | A * | 10/1982 | Patterson | 89/1.11 |
| 4,386,848 | A * | 6/1983 | Clendenin et al. | 244/3.16 |

FOREIGN PATENT DOCUMENTS

FR 2 747 185 A1 10/1997

* cited by examiner

*Primary Examiner* — Bernarr E Gregory
(74) *Attorney, Agent, or Firm* — Oliff & Berridge, PLC

(57) ABSTRACT

The invention relates to a remote control device from an attack module flying over a target, module of the projectile or sub-projectile, missile or attack drone type, for a target designator positioned on a terrain of operations, comprising means to emit a remote control signal that are arranged in the attack module and at least one receiver means for the remote control signal that are integral with the designator and are associated with means to activate the start-up of the designator, wherein the emitter means incorporate at least one light source oriented so as to illuminate the terrain and in that the receiver means incorporate a detector for the radiation emitted by the light source or sources.

10 Claims, 4 Drawing Sheets

REMOTE CONTROL DEVICE FOR A TARGET DESIGNATOR FROM AN ATTACK MODULE, ATTACK MODULE AND DESIGNATOR IMPLEMENTING SUCH DEVICE

BACKGROUND OF THE INVENTION

1. Field of Invention

The technical scope of the invention is that of devices to remotely control a target designator placed on a terrain of operations.

2. Description of the Related Art

Target designators more often than not comprise a laser source enabling a target to be optically designated.

They cooperate with an attack module, such as a projectile or sub-projectile, module that is equipped with optical means enabling the designation beam to be detected after being reflected off a target.

For the purposes of the invention, by attack module we mean a piece of ammunition flying over a target which it is intended to neutralize, for example a projectile, a sub-projectile, a missile or an attack drone. Attack drones are small remote-controlled aircraft (mini planes or mini helicopters). As for all ammunition, these drones are equipped with warheads or other means to neutralize a target.

Depending on the technology of the attack module being implemented, the detected beam may be used to direct the module towards the target. In this case, the attack module is provided with a homing device and steering means enabling it to be oriented towards the light spot detected.

The detected beam is used in some cases to cause the attack module to be triggered. Patent FR-2747185 thus discloses an attack module that is a sub-projectile whose triggering is caused by the detection of the light spot emitted by the target designator.

The advantage of target designators lies in that they enable a reduction in the collateral effects caused by an attack. Indeed, only the designated target may be destroyed by the attack module.

The main drawback to such targets designators is their lack of secrecy. Indeed, most substantial targets (for example, battle tanks) are equipped with means enabling such designation to be detected and a retaliative strike to be made.

In order to improve secrecy, patent FR-2747185 proposes to remotely control the start-up of the designator directly from the attack module. For this a wireless emitter onboard the attack module is used, which transmits a remote-control signal to receiver means integral with the designator.

The designation time can thus be reduced.

This solution, however, has the drawback of being vulnerable to scrambling. Furthermore, given the range of common wireless emitters, there is a risk of the designator being started-up prematurely. It is, furthermore, possible for several designators to be controlled by one attack module (such a drawback could be overcome, however, by using signal coding).

Lastly, because of the long emission range, it is difficult using this concept to control the exact time at which the designator is effectively switched on depending on the configurations of the terrain.

SUMMARY OF THE INVENTION

The aim of the invention is to overcome such drawbacks by proposing remote control means that enable a reduction in the time the designator remains switched on, thereby also reducing its detectability.

The invention lastly enables the exact time the designator is switched on to be controlled.

Thus, the invention relates to a remote control device from an attack module flying over a target, module of the projectile or sub-projectile, missile or attack drone type, for a target designator positioned on a terrain of operations, such device comprising means to emit a remote control signal that are arranged in the attack module and at least one receiver means for the remote control signal that are integral with the designator and are associated with means to activate the start-up of the designator, device wherein the emitter means incorporate at least one light source oriented so as to illuminate the terrain and wherein the receiver means incorporates a detector for the radiation emitted by the light source or sources.

Preferably, the emitter means will ensure the emission of coded signals.

These signals may be transmitted in the form of a pulse train.

The emitter means may incorporate at least two light sources evenly spaced angularly around one axis of the attack module.

The invention also relates to an attack module flying over a target, module of the projectile or sub-projectile, missile or attack drone type implementing such a device, module equipped with target detection means intended to cooperate with a target designator positioned on the terrain, attack module incorporating in addition emitter means ensuring the remote start-up of the designator, attack module wherein the emitter means incorporate at least one light source oriented so as to be able to illuminate a zone of terrain as the attack module flies over the terrain.

The emitter means may incorporate at least two light sources evenly spaced angularly around an axis of the attack module.

The light sources will advantageously be evenly spaced around an optical detector or a homing device.

Lastly, the invention relates to a target designator intended to cooperate with an attack module flying over a target, module of the projectile or sub-projectile, missile or attack drone type, attack module equipped with target detection means and/or designation beam detection means, designator comprising receiver means for a remote control signal emitted by emitter means integral with the attack module, receiver means associated with means to ensure the control of the start-up of the designator, designator wherein the receiver means incorporate at least one detector for the radiation emitted by at least one light source integral with the attack module.

The receiver means may incorporate optics positioned on an upper face of the designator so as to directly receive the light rays emitted by the attack module.

Alternatively, the receiver means may incorporate optics arranged so as to observe a target, the light rays emitted by the light source or sources of the attack module reaching the designator after reflection off the target.

BRIEF DESCRIPTION OF THE DRAWINGS

Other advantages of the invention will become apparent from the following description of the different embodiments, description made with reference to the appended drawings in which.

DETAILED DESCRIPTION OF PREFERRED EMBODIMENTS

Figure 1:
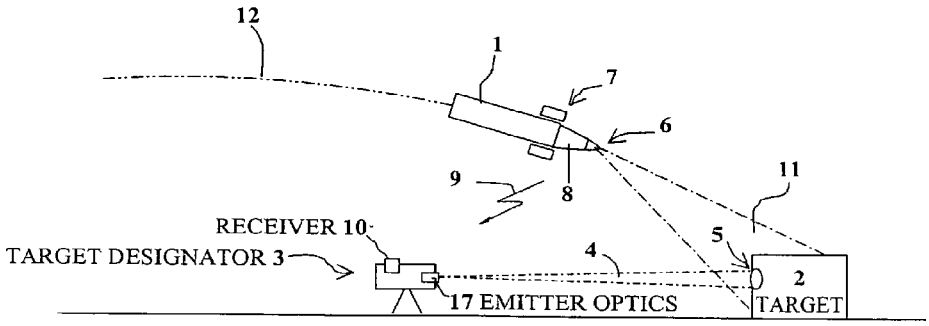
Fig. 1 PRIOR ART
FIG. 1 is a schema showing the conventional implementation of an attack module associated with a target designator.

FIG. 1 shows an attack module 1 (here a projectile) which is projected from a weapon system (not shown) in the direction of a target 2.

A target designator 3 is positioned on the terrain. Classically, this designator projects a laser beam 4 onto the target 2. This results in a laser spot 5 on the target 2, which is seen by the detection means 6 carried on the projectile 1 and which observe the ground in a detection cone 11. These detection means 6 are constituted, for example, by an optical detector or by a homing device, which will be coupled with steering control means comprising, for example, orientable elevons 7.

Conventionally (disclosed, for example, by patent FR2747185), the projectile 1 carries (for example, in a control module 8 located in the nose cone) emitter means for a remote control signal 9.

This known emitter means is a radiofrequency emitter.

The signal 9 that it emits is received by receiver means 10 (for example, an antenna), means which are integral with the designator 3.

The remote control signal enables the designator 3 to be started up. Thus, the latter may be oriented towards the target but remain in its starting, and therefore undetectable, position.

It is only during the passage of a projectile 1 equipped with appropriate remote control means that the designator 3 is started up and ensures the projection of a laser beam 4 towards the target 2.

Such an operating mode is described here with reference to an attack module 1 constituted by a projectile having a ballistic trajectory 12.

It may naturally (as disclosed by patent FR2747185) be implemented from an attack module constituted by one or several sub-munitions scattered above the terrain by a carrier projectile.

This known device suffers drawbacks that have already been mentioned in the first part of the present application. Namely, the signal emission range 9 is relatively long and varies according to the terrain. It is thus impossible to control the exact time at which the designator is started up.

Figure 2:
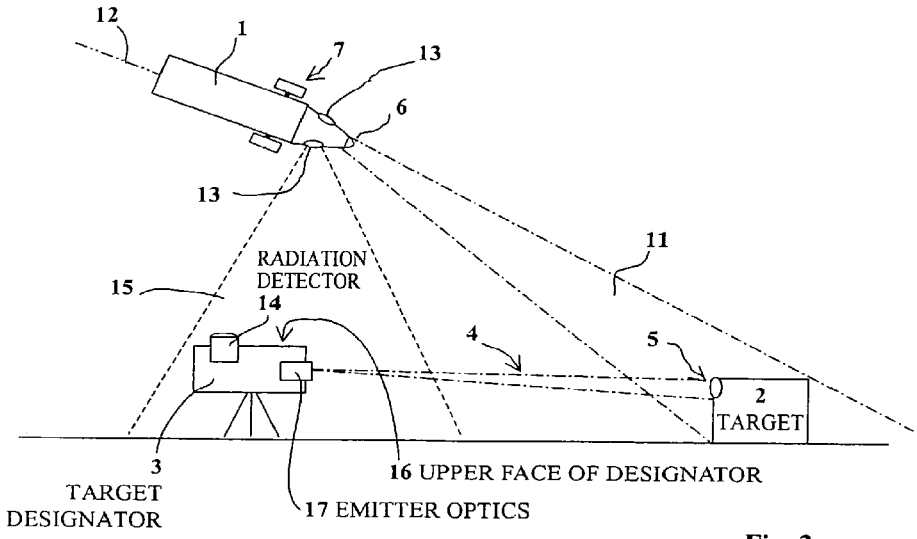
FIG. 2 shows an attack module cooperating with a designator according to a first embodiment of the invention.

FIG. 2 shows a remote control device according to a first embodiment of the invention.

According to this embodiment, the attack module 1 has emitter means that incorporate at least one light source 13 oriented so as to illuminate the terrain.

More specifically, the module 1 carries several light sources 13 evenly spaced angularly around the axis of the attack module. Thus, given the rotation of the module 1 around its axis, the sources 13 illuminate the ground successively one after the other.

Laser sources will preferably be used, thereby enabling the dimensions of the illumination cone 15 emitted by each source 13 to be reduced.

Furthermore, the emitter means carried by the module 1 will preferably be defined such that it ensures the emission by the light sources 13 of coded signals. It is thereby possible for a well-defined designator 3 to be controlled by a given attack module 1.

For this, each designator 3 is attributed a specific identification code and the code corresponding to each designator 3 to be located is introduced into a memory of the attack module 1.

So as to reduce the amount of energy consumed by the attack module, the signals will advantageously be transmitted in the form of a light pulse (or flash) train.

The designator 3 carries receiver means that incorporate at least one detector 14 for the radiation emitted by the light source 13.

According to the embodiment shown in FIG. 2, the designator 3 thus incorporates optics 14 arranged on an upper face 16 of the designator 3. These optics are thus oriented substantially vertically so as to directly receive the light rays emitted by the attack module 1.

The designator furthermore incorporates emitter optics 17 that ensure the projection of the designation beam 4 towards the target 2.

FIG. 2 clearly shows that the beams 15 emitted by the light sources 13 are oriented groundwards in a well determined zone in space. The exact time at which a designator is remotely controlled is thus easily controlled. Indeed, it is only when a designator 3 lies in the path of a beam 15 that it can be started up.

Figure 3:
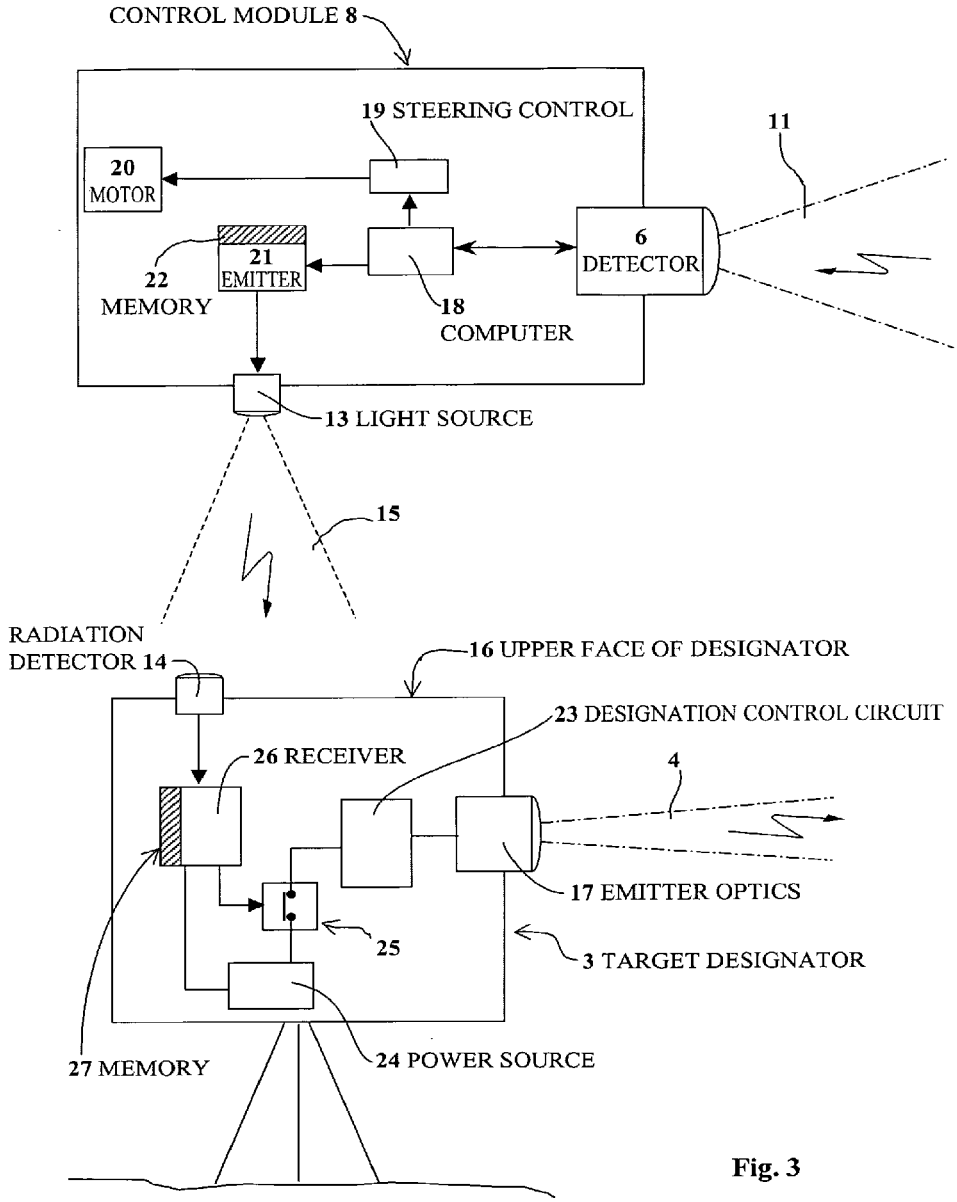
FIG. 3 is an overview diagram of the remote control device structure according to this first embodiment.

FIG. 3 gives a more detailed view of the structure of the remote control device according to the invention, both from the attack module side (of which part of the control module 8 is shown) and the designator 3 side.

The control module 8 carries detection means or a homing device 6 whose optics are shown schematically here. This homing device is linked to an onboard computer 18 that ensures the function required to process the signals received by the homing device 6. The computer 18 is namely linked to steering control means 19 which act on the motors 20 of the elevons (only one motor is shown).

The computer 18 is linked to emitter means 21 of the remote control signal, means that control the light source or sources 13. The emitter means 21 ensure the generation of the remote control signal that may be carrying the coding incorporated in a memory 22 (programmable before firing).

The computer 18 thus controls the beginning of the emission of the remote control signal after a time lapse that runs from the firing time. This time lapse is programmed before firing. The exact time the emission begins is determined using a timer incorporated into the computer 18.

Furthermore, and to avoid excessive energy consumption, the computer 18 will stop the emission of the remote control signal when it begins to detect the designation spot 5 on the target.

The designator 3 incorporates the emitter optics 17 that ensure the projection of the designation beam 4 towards the target 2. These optics (that are generally laser optics) are activated by a control circuit 23 linked to a power source 24 by means of a switch 25.

The radiation detector 14 positioned on the upper face 16 of the designator 3, is furthermore linked to receiver means 26 for the remote control signals, such means also being powered by a power source 24. These receiver means 26 ensure the decoding and recognition of the light signal received. It namely ensures if need be the comparison of the code carried by the signal with that associated with the designator 3 itself and which is programmed in a memory 27.

When the signal 15 received is effectively the signal intended to cause the designator 3 to start up, means 26 cause the switch 25 to close thereby starting up the designator 3.

Naturally, the figures described here are only simplified diagrams enabling the functioning of the invention to be explained. They do not prejudice any practical embodiment that may be made industrially. Namely, all the means incorporates into the designator 3 (and/or the control module 8) may be made in the form of a single electronic card carrying a programmable microprocessor and ensuring the different functions (detection, decoding, control for the start up of the emitter optics, . . . ).

FIGS. 2 and 3 show light sources 13 arranged substantially radially with respect to the body of the attack module 1.

Figure 4:
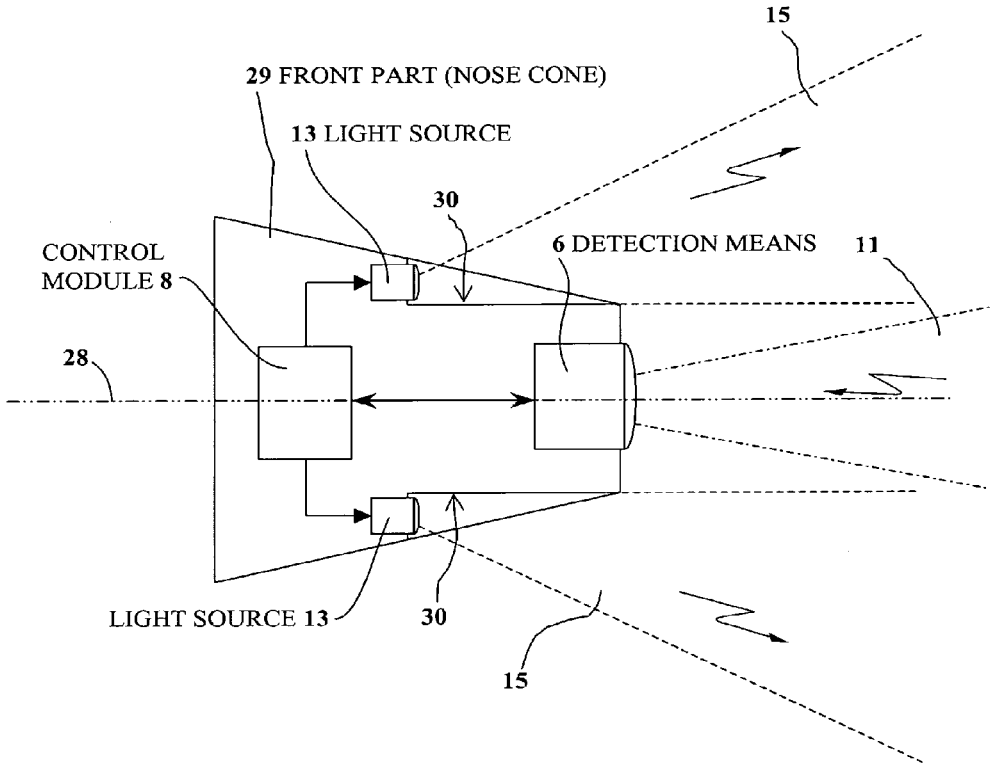
FIG. 4 is a simplified section view of a front part of an attack module according to a variant of this embodiment.

FIG. 4 shows a simplified section view of one example of the integration of the light sources 13 on a front part 29 (or nose cone) of the attack module 1.

According to this example of integration, the nose cone 8 carries the detector (or homing device) 6 on one end. This is arranged on the axis 28 of the attack module 1. It is linked to the control module 8.

The light sources 13 are evenly spaced angularly around the axis 28 of the attack module. Three or four light sources 13 may thus be envisaged.

These sources 13 are linked to the control module 8 and are each positioned in a notch 30 made in the outer surface of the nose cone 19.

The shape of each notch will be defined so as to direct the beams 15 emitted by the sources 13.

Such a configuration of the device enables the zone covered by the remote control means to be even further reduced. Indeed, it is only during the terminal phase of the trajectory of module 1 that the beams 15 ensuring the remote control will illuminate the terrain and only those designators located in a radius of around 300 to 400 m around the theoretical drop point will be able to be remotely controlled.

Figure 5:
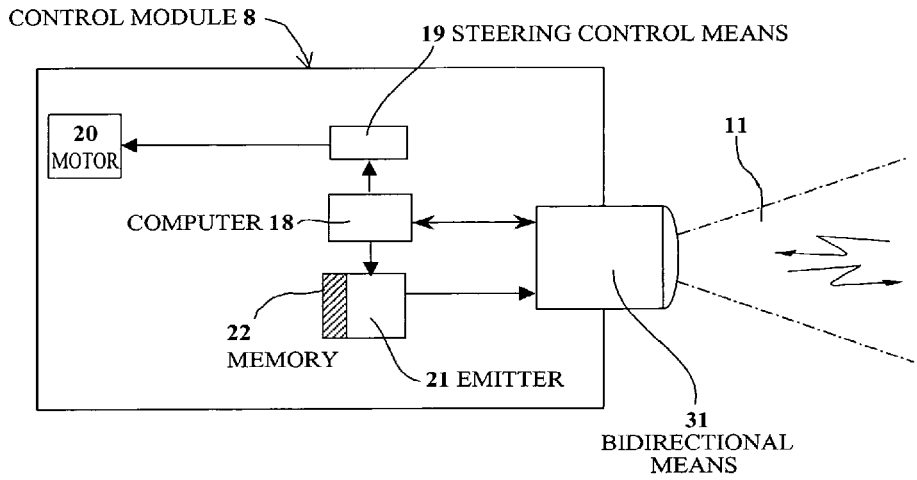
FIG. 5 is an overview diagram of the remote control device structure according to a second embodiment of the invention.
Figure 5:
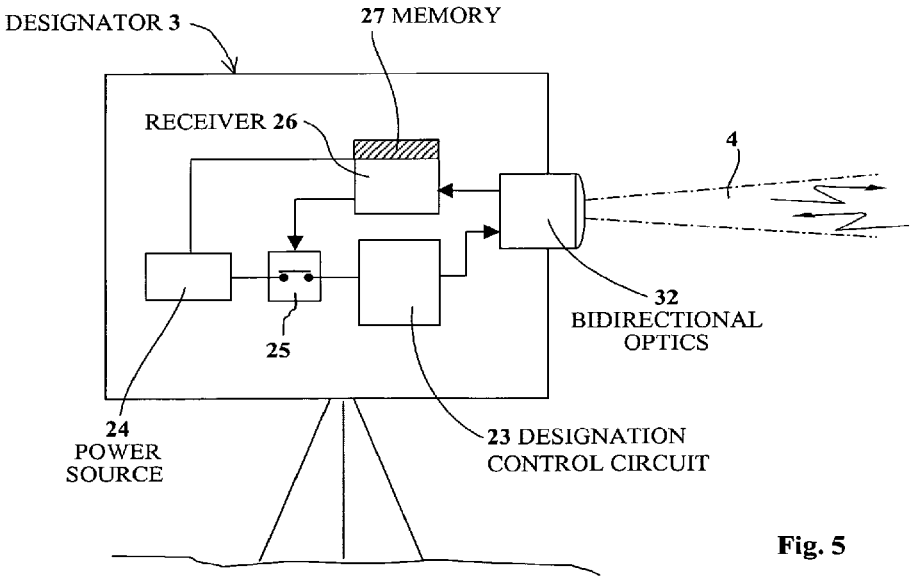

FIG. 5 shows an overview diagram of the structure of a remote control device according to a second embodiment of the invention.

This embodiment differs from the previous one in that the unidirectional detection means 6 have been replaced by bidirectional means 31 which ensure the observation of the terrain and may also emit a coded optical signal. Means 31 may thus both act as detection means 6 and a light source 13.

This is why, on the diagram, these bidirectional optical means 31 are shown linked both to the computer 18 and to the emitter 21 (coupled with the memory 22).

In parallel, with respect to the designator 3, the emitter optics 17 will be replaced by bidirectional optics 32 able to both project a designation beam and receive the remote control signals emitted by means 31.

The bidirectional optical means 32 are thus linked both to the designation control circuit 23 and to the receiver means 26 (coupled with the memory 27).

This embodiment firstly enables the number of components implemented to be reduced, and secondly to make the remote control beam even more selective.

Indeed, in this case the light rays emitted by the remote control means in the attack module 1 no longer reach the designator 3 directly but only after being reflected off a potentially designated target 2.

The designator is started up therefore only in the last instants when the projectile is in direct sight of the potential target.

The invention has been described with reference to an attack module constituted by a projectile. It is understood that the invention may be implemented with other types of attack modules flying over a target and which they are intended to neutralize. The invention may namely be implemented with one or several sub-projectiles scattered by a vector (such as a carrier projectile). It may also be implemented with a missile or attack drone.

What is claimed is:

1. A remote control device for an attack module flying over a target, the attack module being a projectile or sub-projectile, missile or attack drone, and being for a target designator positioned on a terrain of operations, the remote control device comprising:

means to emit a remote control signal that are arranged in the attack module; and at least one receiver means for the remote control signal, the at least one receiver means being integral with the designator and associated with means to activate the designator, wherein said emitter means includes at least one light source oriented to illuminate the terrain, and said at least one receiver means includes a detector for the radiation emitted by said at least one light source.

2. A remote control device according to claim 1, wherein said emitter means emits coded signals.

3. A remote control device according to claim 2, wherein said coded signals are transmitted as a pulse train.

4. A remote control device according to claim 2, wherein said at least one light source comprises at least two light sources that are evenly spaced angularly around one axis of said attack module.

5. An attack module flying over a target, the attack module being a projectile or sub-projectile, missile or attack drone, comprising:

target detection means to cooperate with a target designator positioned on a terrain; and emitter means activating remotely the target designator, wherein said emitter means includes at least one light source oriented to illuminate a zone of said terrain as said attack module flies over the terrain.

6. An attack module according to claim 5, wherein said at least one light source comprises at least two light sources that are evenly spaced angularly around an axis of the attack module.

7. An attack module according to claim 5, wherein said at least one light source comprises at least two light sources that are evenly spaced angularly around an optical detector or a homing device.

8. A target designator to cooperate with an attack module flying over a target, the attack module being a projectile or sub-projectile, missile or attack drone, the attack module being equipped with a means to detect at least one of a target and a designation beam, the target designator comprising:

receiver means for receiving a remote control signal emitted by emitter means, the receiver means being integral with said attack module, and including means to activate said target designator, wherein said receiver means includes at least one detector for light rays emitted by at least one light source integral with said attack module.

9. A target designator according to claim 8, wherein said receiver means incorporates optics positioned on an upper face of said designator to directly receive the light rays emitted by said attack module.

10. A target designator according to claim 8, wherein said receiver means incorporates optics arranged to observe a target, the light rays emitted by said at least one light source of said attack module reaching said designator after reflection off said target.

* * * * *